US007431223B2

(12) United States Patent
Göhring

(10) Patent No.: US 7,431,223 B2
(45) Date of Patent: Oct. 7, 2008

(54) SPRAY GUN

(75) Inventor: Alfred Göhring, Salem (DE)

(73) Assignee: J. Wagner GmbH, Markdorf (DE)

( * ) Notice: Subject to any disclaimer, the term of this patent is extended or adjusted under 35 U.S.C. 154(b) by 0 days.

(21) Appl. No.: 11/732,930

(22) Filed: Apr. 5, 2007

(65) Prior Publication Data

US 2007/0241208 A1 Oct. 18, 2007

(30) Foreign Application Priority Data

Apr. 12, 2006 (EP) ..... 06007643

(51) Int. Cl.
*B05B 1/28* (2006.01)
*B05B 7/02* (2006.01)
*B05B 7/30* (2006.01)

(52) U.S. Cl. ..... 239/296; 239/340; 239/526; 239/DIG. 14

(58) Field of Classification Search ..... 239/296, 239/340, 526, DIG. 14, 290, 302, 343, 525, 239/591, 602
See application file for complete search history.

(56) References Cited

U.S. PATENT DOCUMENTS 2,646,314 A * 7/1953 Peeps ..... 239/296
2,800,291 A 7/1957 Stephens
4,349,153 A * 9/1982 Johnson ..... 239/105
4,478,370 A * 10/1984 Hastings ..... 239/707
4,501,394 A * 2/1985 Kwok ..... 239/296
5,386,955 A 2/1995 Savill
5,860,626 A 1/1999 Moser
2004/0083938 A1 5/2004 Olsen et al.
2005/0001060 A1 * 1/2005 Robinson ..... 239/291
2005/0269425 A1 12/2005 Gohring et al.

FOREIGN PATENT DOCUMENTS

AU 745411 3/2002
DE 100 23 408 10/2001
WO WO 2005/038271 4/2005

* cited by examiner

*Primary Examiner*—Darren W Gorman
(74) *Attorney, Agent, or Firm*—Pandiscio & Pandiscio

(57) ABSTRACT

A spray gun for spraying paints and similar viscous media that can be propelled pneumatically, comprising a gun housing for accommodating components of the spray gun that effect propulsion, mixture and/or metering, a handle projecting from the gun housing, and a reservoir tank removably attached to the gun housing for holding the medium to be processed, with the housing of the spray gun provided with an air guidance duct through which the compressed air responsible for atomization flows to an atomizer nozzle, wherein surfaces of the air guidance duct and/or atomizer nozzle, and/or an air cap, which come into contact with the stream of compressed air, or are wetted, are provided wholly or in part with a structured surface in the form of indentations and/or protrusions worked into the surfaces.

5 Claims, 5 Drawing Sheets

Fig. 4a
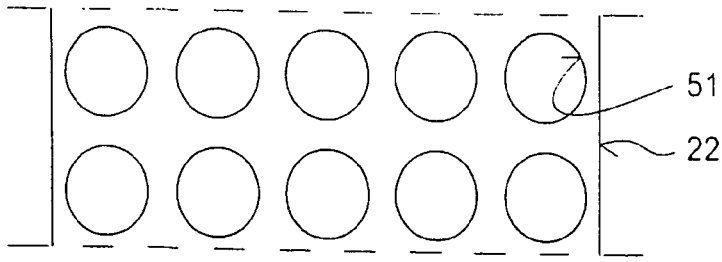
Fig. 4b
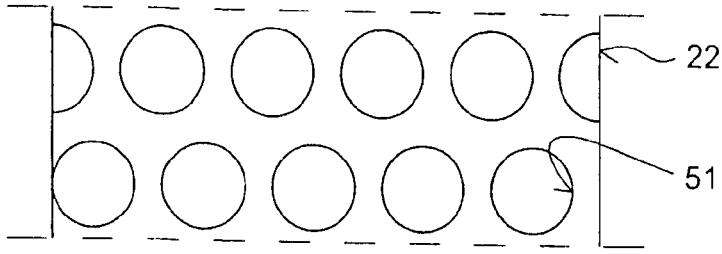
Fig. 4c
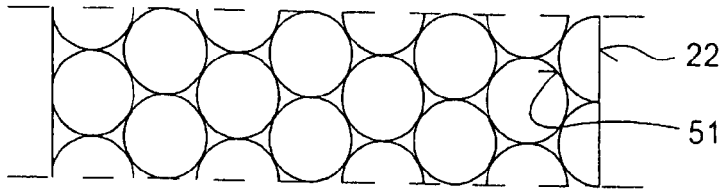
Fig. 4d
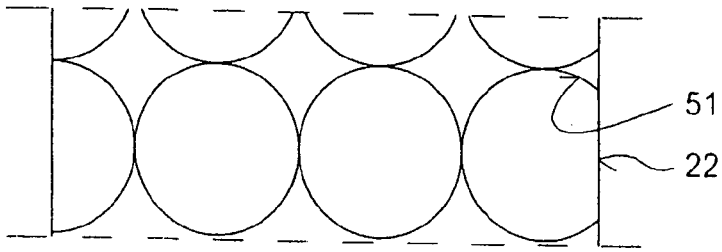
Fig. 5a
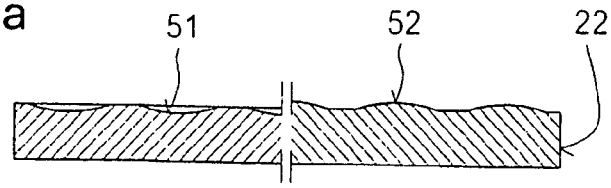
Fig. 5b

SPRAY GUN

BACKGROUND OF THE INVENTION

1. Field of the Invention

The present invention relates to a spray gun for spraying paints and similar viscous media that can be propelled pneumatically, comprising a gun housing for accommodating the components of the spray gun that effect propulsion, mixture and/or metering, a handle projecting from the gun housing, and a reservoir tank removably attached to the gun housing for holding the medium to be processed, with the housing of the spray gun provided with an air guidance duct through which the compressed air responsible for atomization flows to an atomizer nozzle.

2. Description of the Prior Art

In disclosed spray guns of this type, the surfaces of the individual components that come into contact with the compressed air responsible for atomization have a smooth configuration so that the friction resistance is kept low. Although these embodiments have proven their effectiveness in practice, it is only possible to increase the atomizer performance by increasing the pumping pressure. Amongst other factors, this demands a considerable amount of construction complexity and involves a permanently increased power consumption, with the effect that the efficiency and economy of a spray gun are unfavorably influenced.

A spray gun of this type for atomizing fluids is disclosed in DE 10 2004 027 551 A1, wherein an atomizer nozzle is arranged in a sleeve. The handle projects from the sleeve. A reservoir tank is removably attached to the sleeve. The air flow required for atomization is generated by an air turbine driven by an electric motor. The components that come into contact with the air flow do not have a structured surface, so as to reduce the flow resistance.

SUMMARY OF THE INVENTION

The purpose of the present invention is therefore to create a spray gun using structural methods alone that enables the air speed to be increased and therefore allows an increase in the pumping rate of the medium to be transported. The constructional complexity required in order to achieve this should be kept small while retaining the full range of functions, and while allowing a significantly higher quantity of the medium to be transported with the same energy requirement, although at a higher speed.

In accordance with the present invention, this is achieved in a spray gun of the aforementioned type in which the surfaces of the air guidance duct and/or atomizer nozzle, and/or an air cap, which come into contact with the stream of compressed air, or are wetted, are provided wholly or in part, with a structured surface in the form of indentations and/or protrusions worked into the surfaces, either successively or with lateral spacings therebetween.

The projected surfaces of the indentations and/or protrusions can be circular, rectangular, oval, ellipsoid, lens-shaped or polygonal.

Regularly formed indentations and protrusions can be arranged, preferably with an even distribution, on the surfaces that come into contact with the flow of air. However, it is also possible for the surfaces that come into contact with the flow of air to have irregularly formed protrusions and indentations arranged unevenly thereon.

The indentations and/or protrusions can also be embodied as scales, preferably overlapping, arranged in the flow direction.

The indentations and/or protrusions are provided with a lateral extent of 1 to 10 mm and a maximum depth or height of 3 mm.

If the surfaces of a spray gun that come into direct contact with compressed air are configured in accordance with the present invention, it is possible to achieve a significant increase in the pumping speed for the same energy consumption as is required with conventional, smooth contact surfaces, with the effect that the transport rates can be significantly increased without needing to input additional energy. This is because the indentations and/or protrusions provided reduce the air resistance at the surfaces of the components. Depending on the type and arrangement of the indentations and/or protrusions, it is possible to achieve increases of up to 30% in the transport quantities. In this way, the transport quantity of a medium to be processed can be increased significantly without significant constructional complexity and, above all, without requiring the pump unit to draw additional power.

BRIEF DESCRIPTION OF THE DRAWINGS

The drawings shows various sample embodiments of a spray gun configured in accordance with the present invention, which are explained in detail below. In the drawings.

FIGS. 4 to 4*d* show various arrangements of indentations and/or protrusions as schematic views;

FIGS. 5*a* and 5*b* show indentations and protrusions in sectional views;

DESCRIPTION OF THE PREFERRED EMBODIMENTS

Figure 1:
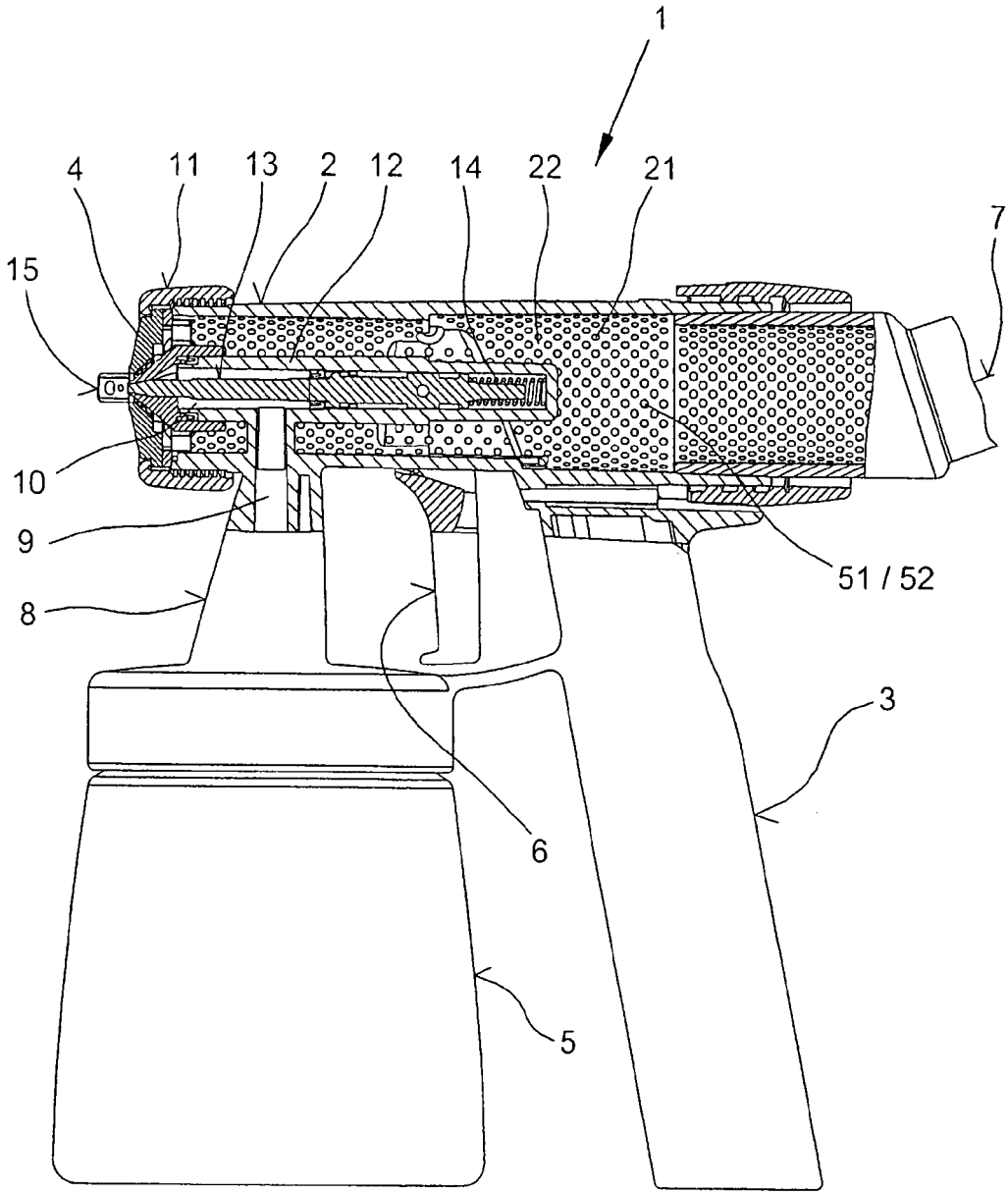
FIG. 1 shows the spray gun with indentations in the surface of the air guidance duct.
Figure 2:
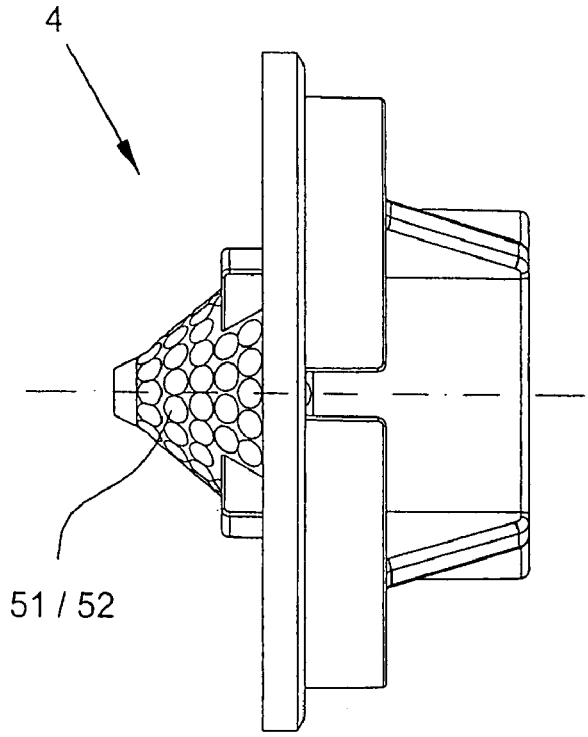
FIGS. 2 and 3 show the atomizer nozzle and air cap of the spray gun in accordance with FIG. 1, in magnified views.

The spray gun 1 shown in FIG. 1 is used for spraying paints And similar viscous media and principally consists of a gun housing 2 for Accommodating the components that are required for operating the spay gun 1, a handle 3 projecting from the gun housing 2, and a reservoir tank 5 for holding the medium to be processed. An actuating lever 6 in a swiveling mounting is provided in order to trigger a spraying operation which, when it is moved, ejects the medium sucked out of the reservoir tank 5 mixed with air out of an atomizer nozzle 4 by means of compressed air supplied via a pressure line 7.

The reservoir tank 5 in the illustrated embodiment is screwed into a projection 8 that is firmly connected to the gun housing 2 and has a duct 9 connected to the reservoir tank 5 and an annular chamber 10. The annular chamber 10 is created by a sleeve 12 into which a nozzle needle 13 is inserted. The nozzle needle 13 can be moved to the right, as show in FIG. 1, against the force of a compression spring 14 with the help of the handle 3, with the effect that the compressed air passing through the spray gun 1 sucks the medium to be processed from the reservoir tank 5 and emits it through the atomizer nozzle 4 that is supported against the gun housing 2 and the sleeve 12 by means of a nozzle nut 11.

Figure 3:
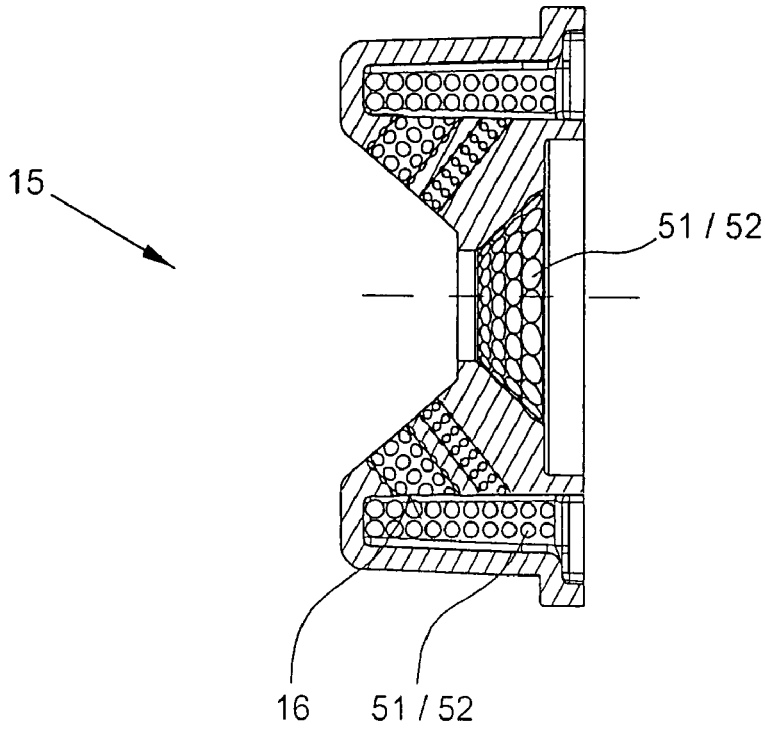

In order to increase the air speed in the gun housing 2, as well as between the atomizer nozzle 4 and an air cap 15 allocated to the nozzle 4, all of the surfaces of the spray gun 1 that come into contact with the flow of compressed air are wetted in an air guidance duct 21 provided in the gun housing 2, therefore its inner jacket surface 22, as well as the atomizer nozzle 4 and the air cap 15, as well as the ducts 16 (FIG. 3) formed in the air cap 15, are provided with indentations 51 and/or protrusions 52 that can be configured in different ways. The air resistance is thereby decreased with the effect that transport quantities can be increased significantly without additional energy having to be consumed.

FIGS. 4*a* to 11 present individual schematic views of how the indentations 51 and/or protrusions 52 can be configured.

In accordance with FIG. 4*a*, the indentations 51 worked into the inner jacket surface 22 have a circular shape in their projected surface and are regularly arranged with a lateral clearance from one another. In FIG. 4*b*, on the other hand, the indentations 51 are distributed over the inner jacket surface 22 with a lateral offset. The indentations in FIG. 4*c* are directly adjacent to one another, while in FIG. 4*d* the indentations 51 have a larger diameter than in the previous embodiments and are arranged in rows.

FIGS. 5*a* and 5*b* show sectional views of the gun housing 2, thereby allowing the indentations 51 and protrusions 52 to be recognized as such.

Figure 6:
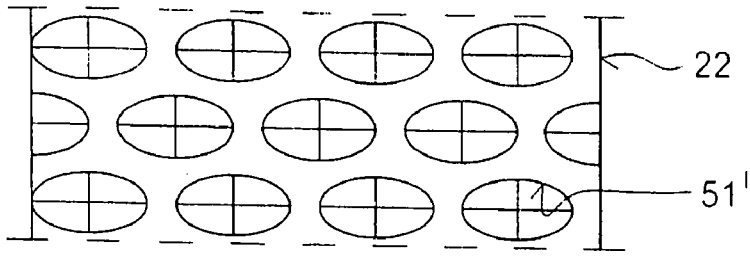
FIGS. 6 to 10 show various embodiments of indentations and/or protrusions in various arrangements.
Figure 7:
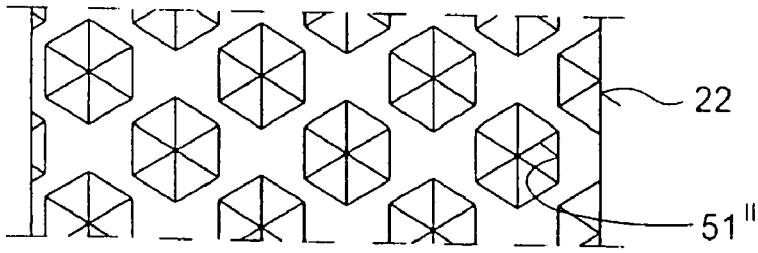

In accordance with FIG. 6, the indentations 51' can have an oval or elliptical shape, while the projected surface of the indentations 51" shown in FIG. 7 is hexagonal.

Figure 8:
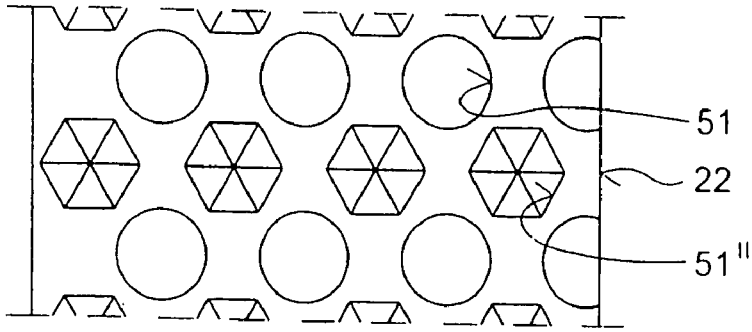
Figure 9:
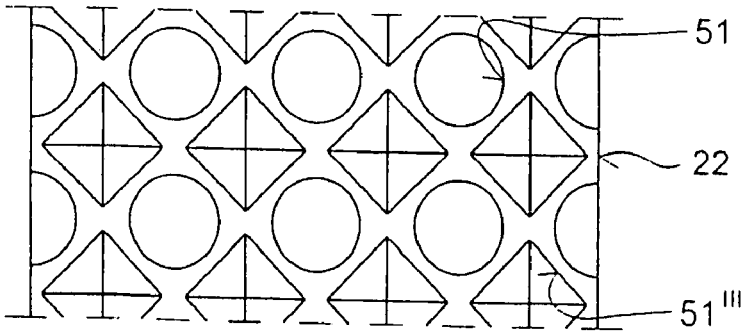
Figure 10:
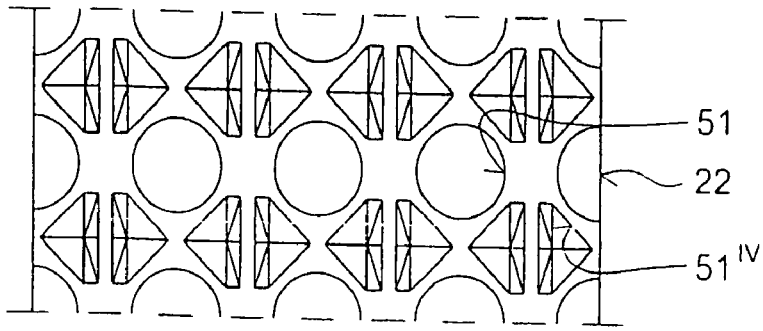

FIG. 8 shows circular indentations 51 and hexagonal indentations 51" worked into the inner jacket surface 22 at regular intervals from one another, while FIG. 9, on the other hand, shows circular indentations 51 and square indentations 51'''. FIG. 10 shows the arrangement of circular indentations 51 and polygonal indentations $\mathbf{51}^{IV}$ in the inner jacket surface 22.

Figure 11:
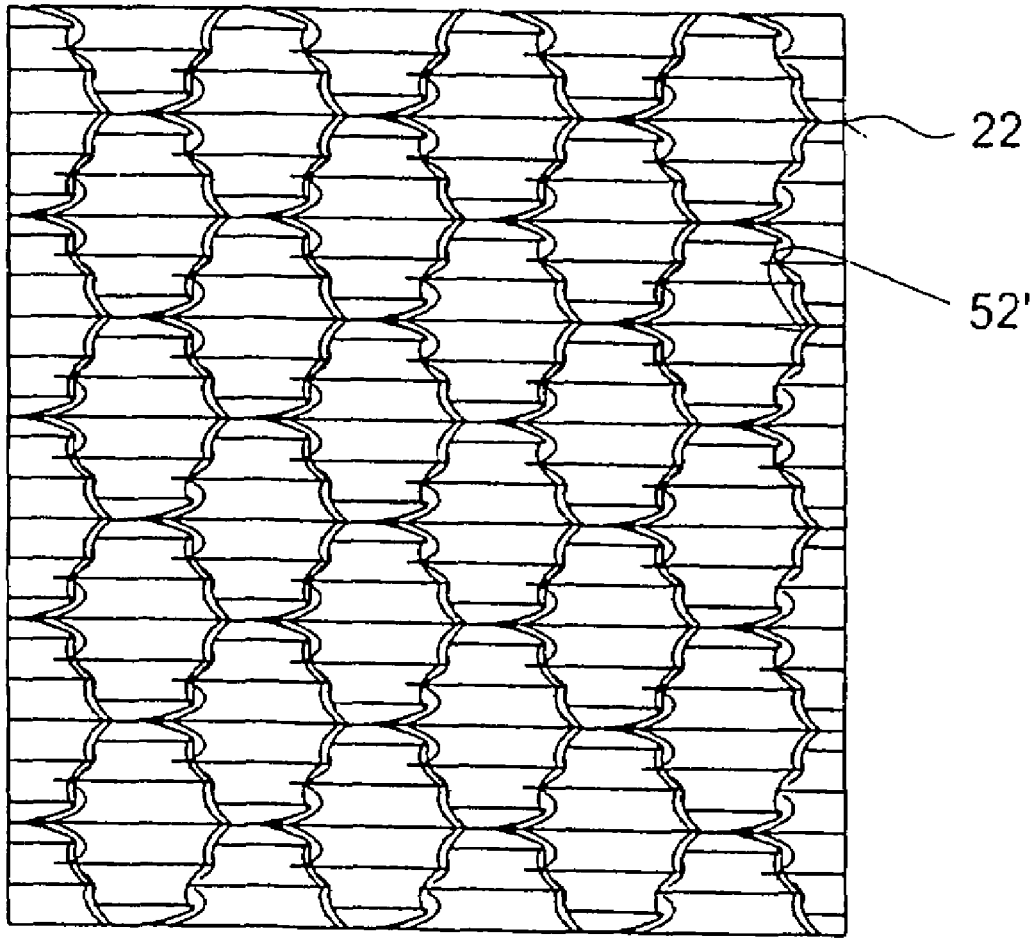
FIG. 11 shows protrusions embodied as scales.

The inner jacket surface 22 of the air guidance duct 21 of the spray gun 1 can, However, also be configured, as shown in FIG. 11, with protrusions 52' and/or indentations configured as scales. To a certain extent, the inner jacket surface 22 is therefore covered with a shark skin profile which reduces the flow resistance of the compressed air flow.

The invention claimed is:

1. A spray gun (1) for spraying paints and similar viscous media that can be propelled pneumatically, comprising a gun housing (2) for accommodating components of the spray gun (1) that effect propulsion, mixture and/or metering, a handle (3) projecting from the gun housing (2), and a reservoir tank (5) removably attached to the gun housing (2) for holding the medium to be processed, with the housing (2) of the spray gun (1) provided with an air guidance duct (21) through which the compressed air responsible for atomization flows to an atomizer nozzle (4), wherein internal surfaces (22) of at least one of the air guidance duct (21), the atomizer nozzle (4), and an air cap (15), which come into contact with the stream of compressed air, are wetted and are provided at least in part with a structured surface in the form of at least one of indentations (51) and protrusions (52) worked into the surfaces either successively or with spacings therebetween.

2. The spray gun in accordance with claim 1, wherein surfaces of the indentations (51) and protrusions (52) are at least one of circular, rectangular, oval, ellipsoid, and polygonal in configuration.

3. The spray gun in accordance with claim 1, wherein the indentations and protrusions are arranged with an even distribution on the surfaces that come into contact with the flow of air.

4. A spray gun (1) for spraying paints and similar viscous media that can be propelled pneumatically, comprising a gun housing (2) for accommodating components of the spray gun (1) that effect propulsion, mixture and/or metering, a handle (3) projecting from the gun housing (2) and a reservoir tank (5) removably attached to the gun housing (2) for holding the medium to be processed, with the housing (2) of the spray gun (1) provided with an air guidance duct (21) through which the compressed air responsible for atomization flows to an atomizer nozzle (4), wherein surfaces (22) of at least one of the air guidance duct (21), the atomizer nozzle (4), and an air cap (15). which come into contact with the stream of compressed air, are wetted and are provided at least in part with a structured surface in the form of at least one of indentations (51) and protrusions (52) worked into the surfaces either successively or with spacings therebetween; and wherein the indentations and protrusions (52') comprise overlapping scales, arranged in a flow direction.

5. The spray gun in accordance with claim 1, wherein the indentations (51) and protrusions (52) are provided with a lateral extent of 1 to 10 mm and a maximum depth and height of about 3 mm, respectively.

* * * * *